United States Patent [19]

Kishida

[11] Patent Number: 4,979,522

[45] Date of Patent: Dec. 25, 1990

[54] AUTOMATIC CIGARETTE EXTINGUISHING APPARATUS

[75] Inventor: Hideo Kishida, Tokyo, Japan

[73] Assignee: MIC Japan, Ltd., Japan

[21] Appl. No.: 413,109

[22] Filed: Sep. 27, 1989

[30] Foreign Application Priority Data

Nov. 7, 1988 [JP] Japan ..... 63-144422[U]

[51] Int. Cl.[5] ..... A24D 1/10

[52] U.S. Cl. ..... 131/349; 131/337

[58] Field of Search ..... 131/349, 337, 256, 236

[56] References Cited

U.S. PATENT DOCUMENTS 4,436,101 3/1984 Seatts ..... 131/337

FOREIGN PATENT DOCUMENTS 2242661 3/1974 Fed. Rep. of Germany ..... 131/337

2253822 5/1974 Fed. Rep. of Germany ..... 131/337

*Primary Examiner*—V. Millin

*Attorney, Agent, or Firm*—Remy J. VanOphem

[57] ABSTRACT

An automatic cigarette extinguishing apparatus includes a tank portion located at an arbitrary position inside tobacco and made of a material having a melting point lower than a combustion temperature of the tobacco, and an extinguishing agent stored in the tank portion. The tank portion is arranged to supply the extinguishing agent inside the tobacco upon combustion of the tobacco.

5 Claims, 2 Drawing Sheets

AUTOMATIC CIGARETTE EXTINGUISHING APPARATUS

BACKGROUND OF THE INVENTION

The present invention relates to an automatic cigarette extinguishing apparatus capable of automatically extinguishing a lit cigarette.

In recent years, careless handling of lit cigarettes leads to an enormous amount of damage. For example, some smokers carelessly enjoy smoking in bed, throw cigarette butts away, or leave lit cigarettes on ash trays without putting them out. In particular, when a lit cigarette butt is thrown away on a mountain road and causes the wood fire, the wood fire results in not only loss of a forest but also loss of houses and livestock. In addition, the wood fire may endanger mens' lives.

In order to prevent careless handling of lit cigarettes, social environments for urging smokers to take caution and specifying smoking areas have been created. However, an effect of these social environments is not sufficient yet.

Cigarette smoking is reported to be hazardous to health. Broadcast of cigarette CMs on TV has been voluntarily restricted, and a caution "cigarette smoking is hazardous to your health" is printed on a package of cigarettes. In this manner, consensus about harmful effects of smoking has been evoked.

Once people are accustomed to smoking, they suffer from a slight chronic nicotinism. It is therefore difficult for smokers to put out cigarette butts still having large lengths, and they often smoke cigarettes until cigarette butts have smaller lengths. For this reason, a large amount of nicotine is deposited in their bodies, often resulting in bad health due to heavy smoking.

SUMMARY OF THE INVENTION

It is, therefore, an object of the present invention to provide an automatic cigarette extinguishing apparatus for automatically extinguishing a cigarette at a predetermined combustion position, thereby preventing careless handling of lit cigarette butts and heavy smoking.

In order to achieve the above object of the present invention, there is provided an automatic cigarette extinguishing apparatus having a tank portion located at an arbitrary position inside tobacco and made of a material having a melting point lower than a combustion temperature of the tobacco, and extinguishing means stored in the tank portion, the tank portion being arranged to supply the extinguishing means inside the tobacco upon combustion of the tobacco.

DESCRIPTION OF THE PREFERRED EMBODIMENT

Figure 1A:
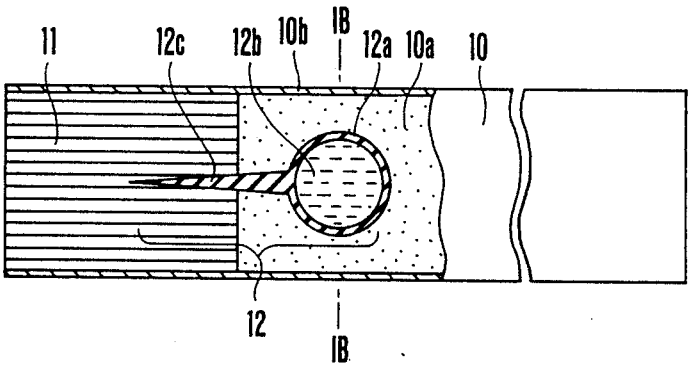
FIG. 1A is a partially sectional view of a cigarette according to the present invention.

FIG. 1A is a partially sectional view showing a cigarette according to the present invention. Reference numeral 10 in FIG. 1A denotes a cigarette; 10*a*, a tobacco portion filled in the cigarette 10; 10*b*, paper which covers the tobacco 10*a*; 11, a filter portion; 12, an automatic cigarette extinguishing apparatus according to the present invention; 12*a*, a spherical tank portion; 12*b*, an extinguishing agent consisting of a liquid such as water stored in the automatic cigarette extinguishing apparatus 12; and 12*c*, a fixing shaft for fixing the automatic cigarette extinguishing apparatus 12 in the tobacco.

Figure 1B:
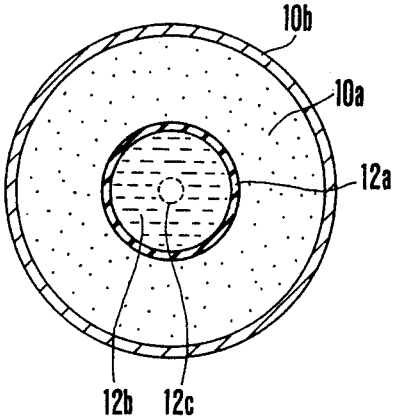
FIG. 1B is a cross-sectional view of the cigarette along the line IB—IB of FIG. 1A.

FIG. 1B is a cross-sectional view showing the cigarette along the line IB—IB of FIG. 1A. As is apparent from FIG. 1B, the automatic cigarette extinguishing apparatus 12 is located on the axis of the cigarette.

Figure 2:
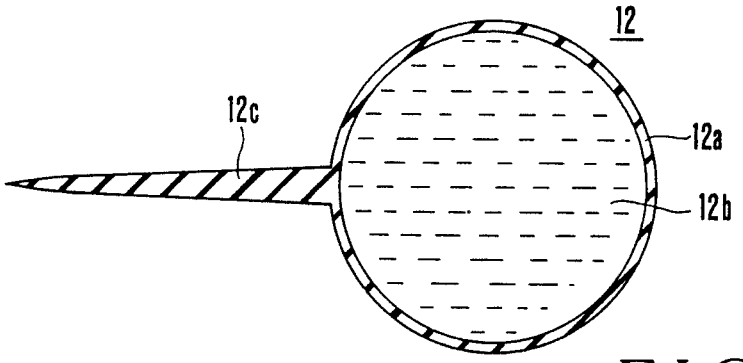
FIG. 2 is a sectional view of an automatic cigarette extinguishing apparatus according to the present invention.

FIG. 2 is a sectional view of the automatic cigarette extinguishing apparatus shown in FIGS. 1A and 1B. The tank 12*a* consists of a meterial (e.g., polypropylene or polyethylene) having a melting temperature lower than a combustion temperature of tobacco and has a thickness of, e.g., about 0.0005 to 1.0 mm. A liquid such as water for putting out the cigarette is stored inside the tank portion 12*a*. The fixing shaft 12*c* is used to fix the automatic cigarette extinguishing apparatus 12 in the tobacco and has a size not to interfere smoking. In the preferred embodiment the material of the fixing shaft 12*c* is the same as that of the tank portion 12*a*, but it may be made from another suitable material.

In the cigarette having the construction described above, a smoker lights the distal end of the cigarette 10 in a normal procedure and then smokes the cigarette. In this case, since the automatic cigarette extinguishing apparatus 12 is located on the axis of the tobacco 10*a*, the apparatus 12 does not interfere with smoking as in normal smoking.

When the combustion of the cigarette 10 progresses and the lit portion reaches the position of the automatic cigarette extinguishing apparatus 12, the tank portion 12*a* of the automatic cigarette extinguishing apparatus 12 is combusted together with the surrounding tobacco. In this case, since the tank portion 12*a* is made of a thin resin layer, it can be easily combusted and melted. Part of the tank portion 12*a* is opened so that the extinguishing agent 12*b* flows out from the tank portion 12*a*. Therefore, the extinguishing agent 12*b* permeates into the surrounding tobacco, and the lit portion is immediately put out. In this case, when the extinguishing agent 12*b* is compressed inside the tank portion 12*a*, a better effect can be expected.

In this embodiment, since the automatic cigarette extinguishing apparatus 12 is located at a predetermined position inside the cigarette 10, a lit cigarette can be put out at the predetermined position. For this reason, damage caused by careless handling of lit cigarettes can be prevented, and at the same time, heavy smoking can also be prevented.

In this embodiment, the automatic cigarette extinguishing apparatus 12 is located adjacent to the filter portion 11. However, the automatic cigarette extinguishing apparatus 12 may be located at an arbitrary position inside the cigarette 10.

The tank portion 12*a* has a spherical shape, but may have a cylindrical or oval shape, or any shape which allows storage of an extinguishing agent therein.

The extinguishing agent 12b may contain a surfactant in an amount which is not hazardous to health so as to allow quick permeation of the agent into the tobacco portion 10a.

Figure 3:
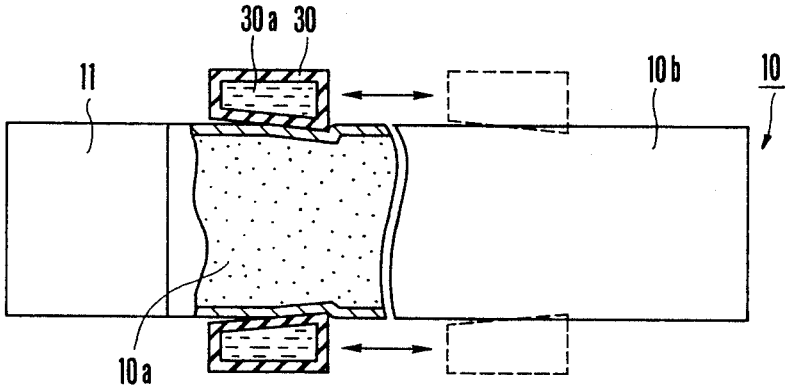
FIG. 3 is a partially sectional view of a cigarette according to another embodiment of the present invention.

FIG. 3 is a partially sectional view of a cigarette according to another embodiment of the present invention. The same reference numerals as in FIG. 1 denote the same parts in FIG. 3. Reference numeral 30 denotes an automatic cigarette extinguishing apparatus having a substantially ring shape; and 30a, an extinguishing agent consisting of a liquid such as water stored in the automatic cigarette extinguishing apparatus 30. The automatic cigarette extinguishing apparatus 30 is located to extend through a cigarette 10 and can be displaced with respect to the cigarette 10, as indicated by a double-headed arrow. In addition, a portion of the automatic cigarette extinguishing apparatus 30 which is brought into contact with the cigarette 10 has a small thickness.

Figure 4:
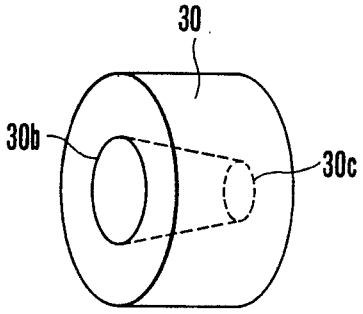
FIG. 4 is a perspective view showing an automatic cigarette extinguishing apparatus of the embodiment shown in FIG. 3.

FIG. 4 is a perspective view showing the automatic cigarette extinguishing apparatus shown in FIG. 3. The diameter of a through hole 30b at one end face of the automatic cigarette extinguishing apparatus 30 is larger than a through hole 30c at the other end face. The inner peripheral surface of the apparatus is conically inclined. For example, when the diameter of the normal cigarette 10 is set to be 8 mm, the diameter of one through hole 30b is set to be 8.5 mm and the diameter of the other through hole 30c is set to be 7.5 mm. Therefore, when the automatic cigarette extinguishing apparatus 30 is inserted from the distal end of the cigarette 10, insertion of the cigarette 10 into the through hole 30b can be facilitated. On the other hand, since the through hole 30c catches the cigarette 10, the automatic cigarette extinguishing apparatus 30 will not be removed from the cigarette 10. The diameter of the cigarette 10 varies depending on different types of cigarette. The diameter of each through hole can vary depending on the diameters of the different types of cigarette.

A smoker lights the distal end of the cigarette 10 by a normal means as in the above embodiment and enjoys smoking. When combustion of the cigarette 10 progresses and the lit portion reaches the position of the automatic cigarette extinguishing apparatus 30, the automatic cigarette extinguishing apparatus 30 is combusted together with the paper 10b. In this case, the resin surface of the automatic cigarette extinguishing apparatus 30 on the side which is in contact with the paper 10b is very thin and can be easily melted. An opening is then partially formed in the automatic cigarette extinguishing apparatus 30, and the extinguishing agent 30a stored therein flows out. Therefore, the extinguishing agent 30a permeates into the tobacco portion 10a through the paper 10b and reaches the lit portion, thereby immediately putting out the cigarette butt.

According to this embodiment, the automatic cigarette extinguishing apparatus 30 can be located at an arbitrary position of the cigarette 10. For example, the automatic cigarette extinguishing apparatus 30 may be located at a position desired by each smoker, thereby preventing heavy smoking.

In each of the above embodiments, cigarettes are exemplified. However, the present invention is also applicable to cigars. In each of the above embodiments, the extinguishing agent is exemplified by a liquid such as water. However, the extinguishing agent may be an inert gas or a solid material enough to put out lit cigarettes.

According to the present invention as has been described above, the automatic cigarette extinguishing apparatus is arranged in a cigarette to automatically put out the cigarette. A lit cigarette can be put out at a desired combustion position of the cigarette. Therefore, damage caused by careless handling of a lit cigarette butt can be prevented.

In addition, since a lit cigarette can be put out at a predetermined combustion position of the cigarette, heavy smoking can be prevented.

What is claimed is:

1. An automatic cigarette extinguishing apparatus comprising:

a tank portion having a through hole through which a cigarette extends, said tank portion being located at an arbitrary position on a peripheral surface of the cigarette through said through hole and being made of a material having a melting temperature lower than a combustion temperature of tobacco; and extinguishing means stored in said tank portion, said tank portion being arranged to supply said extinguishing means to the tobacco upon combustion of the tobacco.

2. An apparatus according to claim 1, wherein said extinguishing means is an extinguishing agent which satisfactorily extinguishes the tobacco and which is nontoxic to a human body.

3. An apparatus according to claim 1, wherein the extinguishing agent consists of a liquid including water.

4. An apparatus according to claim 1, wherein the extinguishing agent is a gas which does not adversely affect smoking.

5. An apparatus according to claim 1, wherein the extinguishing agent is a solid material which does not adversely affect smoking.

* * * * *

UNITED STATES PATENT AND TRADEMARK OFFICE

CERTIFICATE OF CORRECTION

PATENT NO. : 4,979,522

DATED : December 25, 1990

INVENTOR(S) : Hideo Kishida

It is certified that error appears in the above-identified patent and that said Letters Patent is hereby corrected as shown below:

Column 1, line 16, delete "the" (first Occur.) and insert --a--.

Column 1, line 17, delete "a" and insert ---- the ----.

Column 2, line 1, before "DESCRIPTION" insert ---- DETAILED ----.

Column 2, line 22, delete "meterial" and insert ---- material ----.

Signed and Sealed this

Twenty-third Day of June, 1992

*Attest:*

DOUGLAS B. COMER

*Attesting Officer*

*Acting Commissioner of Patents and Trademarks*